US012297547B2

(12) United States Patent
Delannoy et al.

(10) Patent No.: US 12,297,547 B2
(45) Date of Patent: May 13, 2025

(54) COMPRESSIBLE FLOW DISTRIBUTION SYSTEM FOR ELECTROLYZER PLATES

(71) Applicant: Dioxcyle, Saint Ouen sur Seine (FR)

(72) Inventors: Joachim Delannoy, Paris (FR); Jan Rossberg, Ulm (DE); David Wakerley, Paris (FR); Fanny Bétermier, Paris (FR); Sarah Lamaison, Paris (FR); Luc Rouveyre, Cognin (FR)

(73) Assignee: Dioxycle, Saint Ouen sur Seine (FR)

( * ) Notice: Subject to any disclaimer, the term of this patent is extended or adjusted under 35 U.S.C. 154(b) by 0 days.

(21) Appl. No.: 18/819,484

(22) Filed: Aug. 29, 2024

(65) Prior Publication Data

US 2025/0075349 A1 Mar. 6, 2025

Related U.S. Application Data

(60) Provisional application No. 63/535,577, filed on Aug. 31, 2023.

(51) Int. Cl.

| | |
|---|---|
| ***C25B 11/00*** | (2021.01) |
| ***C25B 9/23*** | (2021.01) |
| ***C25B 9/60*** | (2021.01) |
| ***C25B 9/77*** | (2021.01) |
| ***C25B 11/032*** | (2021.01) |
| ***C25B 11/042*** | (2021.01) |

(52) U.S. Cl.

CPC ..... *C25B 11/032* (2021.01); *C25B 9/23* (2021.01); *C25B 9/60* (2021.01); *C25B 9/77* (2021.01); *C25B 11/042* (2021.01)

(58) Field of Classification Search

CPC ..... C25B 11/032; C25B 9/60; C25B 9/77; C25B 9/23; C25B 11/042

See application file for complete search history.

(56) References Cited

U.S. PATENT DOCUMENTS

| | | | | |
|---|---|---|---|---|
| 9,782,853 | B2 | 10/2017 | Müller | |
| 2008/0245662 | A1 | 10/2008 | Forster et al. | |
| 2023/0304176 | A1 * | 9/2023 | Watanabe | C25B 11/051 |

(Continued)

FOREIGN PATENT DOCUMENTS

| | | | |
|---|---|---|---|
| CN | 115341228 | A | 11/2022 |
| WO | 2023070211 | A1 | 5/2023 |

OTHER PUBLICATIONS

J. Kim, et al. (2017). Modeling two-phase flow in three-dimensional complex flow-fields of proton exchange membrane fuel cells. Journal of Power Sources, 365, 419-429.

(Continued)

*Primary Examiner* — Zulmariam Mendez

(74) *Attorney, Agent, or Firm* — Daylight Law, P.C.

(57) ABSTRACT

Methods and systems for fluid distribution in electrolyzer cells are disclosed herein. A disclosed a carbon oxide electrolyzer includes a polar plate, a cathode area, a carbon oxide reactant gas serving as a reduction substrate in the cathode area, a cathode fluid inlet, a cathode fluid outlet, an anode area, a liquid oxidation substrate in the anode area; and a compressed electrically conductive mesh: (i) in electrical contact with the polar plate; and (ii) that provides a fluid path from the cathode fluid inlet to the cathode fluid outlet for the carbon oxide reactant gas through the compressed electrically conductive mesh.

26 Claims, 12 Drawing Sheets

(56) References Cited

U.S. PATENT DOCUMENTS

2023/0317976 A1* 10/2023 Domanski ..... H01M 8/186

OTHER PUBLICATIONS

S. Stiber, et al. (2021). A high-performance, durable and low-cost proton exchange membrane electrolyser with stainless steel components. Energy & Environmental Science.
International Search Report and Written Opinion from International Application No. PCT/IB2024/058424 dated Jan. 2, 2025, 12 pages.

* cited by examiner

COMPRESSIBLE FLOW DISTRIBUTION SYSTEM FOR ELECTROLYZER PLATES

CROSS REFERENCE TO RELATED APPLICATIONS

This application claims the benefit of U.S. Provisional Application No. 63/535,577, filed on Aug. 31, 2023, which is incorporated by reference herein in its entirety for all purposes.

BACKGROUND

A carbon oxide electrolyzer may have one or more electrolyzer cells. A carbon oxide electrolyzer cell can consist of an MEA (Membrane Electrode Assembly) where the carbon oxide reduction takes place, and which is sandwiched between polar plates that serve both as electronic conductors and fluid distributors onto both sides of the MEA. The fluid distribution function may be provided by channels that are etched or otherwise formed into the surface of the polar plate and that provide a fluid flow path across the surface of the polar plate, in contact with the MEA, and from one side of the electrolyzer cell to the other.

SUMMARY

Methods and systems related to fluid distribution for electrolyzer cells are disclosed herein. The fluid distribution systems can be for the distribution of a reactor feedstock or an electrolyte between electrolyzer plates. The fluid distribution systems can be for the distribution of a gas or liquid through the electrolyzer cells. The fluid distribution systems can be configured to allow the fluid to contact an electrode catalyst of the electrolyzer cell while flowing between a fluid inlet to a fluid outlet. The fluid distribution systems can also be configured to either provide an electrically conductive pathway across the electrolyzer cell from an anode of the electrolyzer cell to a cathode of the electrolyzer cell.

The fluid distribution systems can be compressible such that they are compressed when the electrolyzer cell is compressed to form the seals for the cell. The fluid distribution systems can include compressible flow fields. The compressible flow fields can be formed of electrically conductive compressible material. The compressible flow fields disclosed herein can be formed of a single compressible electrically conductive mesh that is the same shape as the active area of the electrolyzer cell. Alternatively, the compressible flow fields disclosed herein can be formed of separate pieces of compressible electrically conductive material that are the same shape as a patterned channel in the active area of the electrolyzer cell. The patterned channels can be etched, machined, stamped, formed by deep drawing, or other methods, and can be located on the surface of the polar plate of the electrolyzer cell.

Specific compressible fluid distribution systems disclosed herein can provide significant benefits in that the compressible fluid distribution systems obviate the need for channels to be patterned in the surface of the polar plate as the compressible fluid distribution systems can provide the same functionality as patterned channels through the introduction of a single compressible conductive mesh that is placed on the surface of the polar plates. This aspect of the fluid distribution system can reduce the cost of the cell as precise machining of the fluid channels is no longer required. Additionally, certain carbon oxide electrolyzers need a high level of compression (e.g., 1 M Pascal) on the components of the cell in order to assure good catalytic performance. For example, a carbon monoxide electrolyzer with a copper catalyst on the cathode side may require high compression in order to assure the catalyst is brought into contact with the membrane of the cell. In these electrolyzers, the use of a compressible conductive mesh is particularly beneficial in that it provides an even distribution of this compressive force across the surface of the electrodes as compared to fluid distribution systems with patterned channels where the compressible force is only distributed across the negative of the channels.

Polar plates with patterned channels have been used previously in carbon oxide electrolyzers having an aqueous phase on one side of the membrane and a gaseous phase on the other side of the membrane due to the specific configuration and operational characteristics of such cells. In particular, these cells can utilize a pressure differential of up to 0.8 bar in order to prevent leakage of the aqueous electrolyte across the membrane into the gaseous phase portion of the cell. This pressure differential can be maintained by controlling the introduction of the volume of feedstock and electrolyte into the fluid distribution systems on either side of the membrane. Heretofore, it was assumed that only fluid distribution systems formed by patterned channels would have sufficient characteristics for the refined control of this pressure differential through the introduction of feedstocks and electrolyte thereto. However, the inventors of the Present Application have determined that compressible meshes of conductive material with properly selected pore sizes afford sufficient control of the pressure differential while at the same time realizing the benefits of compressible conductive meshes mentioned in the prior paragraph.

In specific embodiments, a carbon oxide electrolyzer cell is provided. The carbon oxide electrolyzer cell comprises a polar plate, a cathode area, a carbon oxide reactant gas serving as a reduction substrate in the cathode area, a cathode fluid inlet, a cathode fluid outlet, an anode area, a liquid oxidation substrate in the anode area; a compressed electrically conductive mesh: (i) in electrical contact with the polar plate; and (ii) that provides a fluid path from the cathode fluid inlet to the cathode fluid outlet for the carbon oxide reactant gas through the compressed electrically conductive mesh.

In specific embodiments, a carbon oxide electrolyzer cell is provided. The carbon oxide electrolyzer comprises a polar plate, a cathode area, a carbon oxide reactant gas serving as a reduction substrate in the cathode area, a cathode fluid inlet, a cathode fluid outlet, a membrane, a compressed electrically conductive mesh: (i) comprising steel; (ii) in electrical contact with the polar plate; and (iii) that provides a fluid path from the cathode fluid inlet to the cathode fluid outlet for the carbon oxide reactant gas through the compressed electrically conductive mesh, and a separate carbon-based gas diffusion layer having a catalyst thereon between the compressed electrically conductive mesh and the membrane.

In specific embodiments, a method of forming an electrolyzer cell is provided. The method comprises attaching a polar plate to a first compression plate, whereby the polar plate and the first compression plate form an electrode fluid inlet and an electrode fluid outlet, although in some variants, a cell frame can contain the fluid inlet and outlet of each cell. The method also comprises placing an electrically conductive mesh on the polar plate, placing an electrode catalyst on the electrically conductive mesh, and compressing, in a compression using the first compression plate, the electrically conductive mesh such that it is a compressed electrically conductive mesh, whereby the compressed electrically conductive mesh is positioned to allow a fluid flow from the electrode fluid inlet to the electrode fluid outlet through the compressed electrically conductive mesh.

BRIEF DESCRIPTION OF THE DRAWINGS

The accompanying drawings illustrate various embodiments of systems, methods, and various other aspects of the disclosure. A person with ordinary skill in the art will appreciate that the illustrated element boundaries (e.g., boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another and vice versa. Furthermore, elements may not be drawn to scale. Non-limiting and non-exhaustive descriptions are described with reference to the following drawings. The components in the figures are not necessarily to scale, emphasis instead being placed upon illustrating principles.

DETAILED DESCRIPTION

Figure 1:
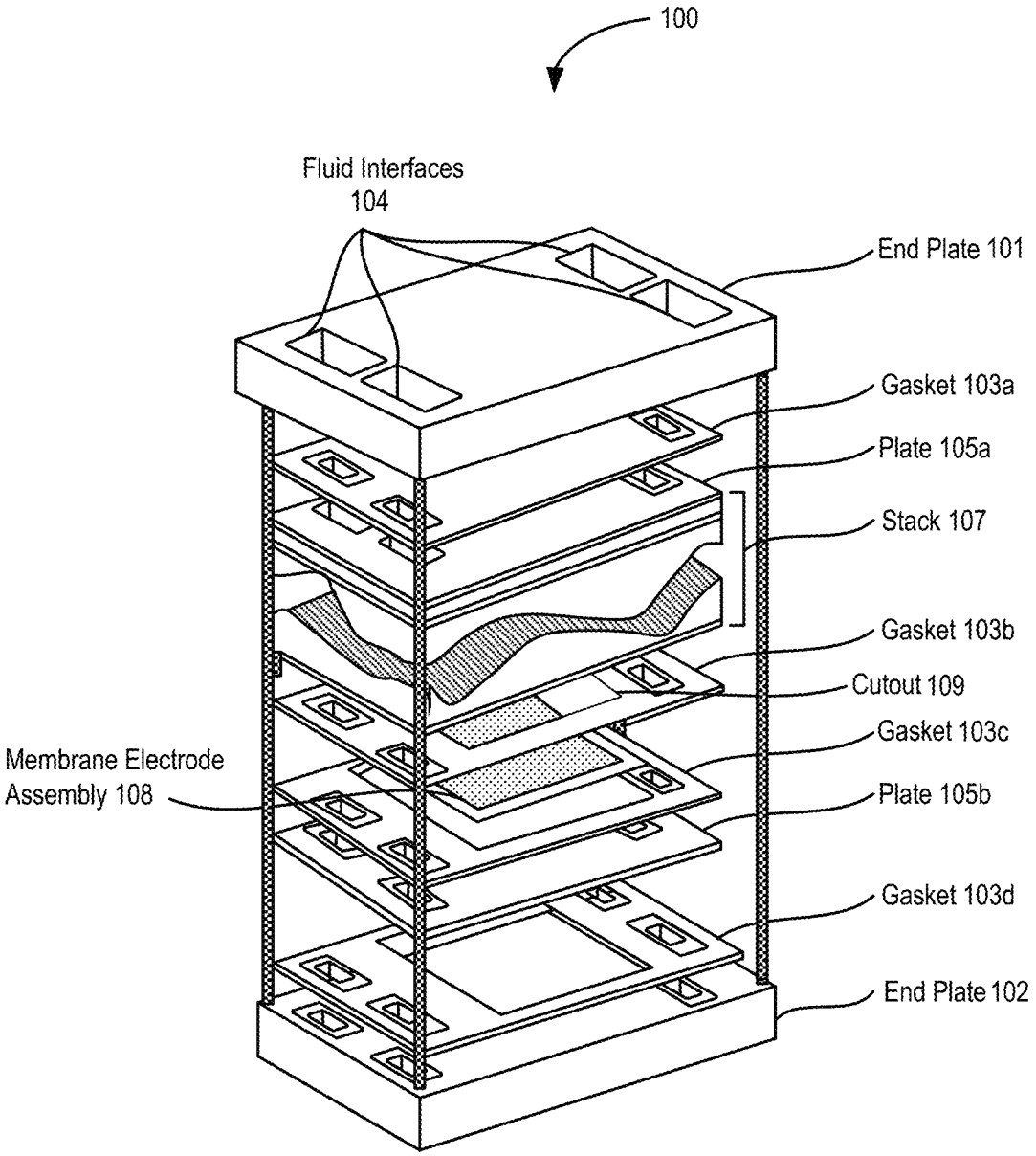
FIG. 1 is an exploded diagram of an electrolyzer stack in accordance with specific embodiments of the inventions disclosed herein.

Reference will now be made in detail to implementations and embodiments of various aspects and variations of systems and methods described herein. Although several exemplary variations of the systems and methods are described herein, other variations of the systems and methods may include aspects of the systems and methods described herein combined in any suitable manner having combinations of all or some of the aspects described.

Methods and systems for fluid distribution in electrolyzer cells are disclosed in detail herein. The methods and systems disclosed in this section are nonlimiting embodiments of the invention, are provided for explanatory purposes only, and should not be used to constrict the full scope of the invention. It is to be understood that the disclosed embodiments may or may not overlap with each other. Thus, part of one embodiment, or specific embodiments thereof, may or may not fall within the ambit of another, or specific embodiments thereof, and vice versa. Different embodiments from different aspects may be combined or practiced separately. Many different combinations and sub-combinations of the representative embodiments shown within the broad framework of this invention, that may be apparent to those skilled in the art but not explicitly shown or described, should not be construed as precluded.

Methods and systems for the formation of seals and flow fields in an electrolyzer are disclosed herein. In specific embodiments, the electrolyzers include compressible flow distribution systems. The compressible flow distribution system can include compressible porous material such as porous foam, porous metal, or compressible metal that forms the flow fields of the electrolyzer. The compressible flow distribution system can be arranged on a plate of an electrolyzer stack where the plate is entirely flat, or at least simplified with respect to the plates of standard electrolyzer stacks. The compressible porous material can be surrounded by gasket material that forms seals between adjacent channels in the flow distribution system. The gasket can be a loose gasket that is placed on the surface of the plate and is compressed and held in place as the plate is compressed in an electrolyzer stack.

The electrolyzers disclosed herein can be carbon oxide electrolyzers that convert carbon oxides such as carbon dioxide and carbon monoxide into valuable products in response to the application of a voltage across the anode and cathode of the electrolyzer. Anodes and cathodes are both referred to herein using the term electrode. The valuable products can be produced via a reduction reaction which results in the reduction of the carbon oxide on the cathode side of the electrolyzer and a corresponding oxidation reaction which results in the oxidation of a reactant on the anode side of the electrolyzer. The valuable products can be chemicals such as, but not limited to, carbon monoxide, hydrogen, oxygen, alkanes, alkenes, alcohols, carboxylic acids, and aldehydes.

The electrolyzers can include one or more cells that are defined by an active area in which the electrochemical reactions take place to generate the valuable products. The electrolyzer can utilize fluid flow fields which allow for fluid flow through the active area to carry reactants into the active area and to carry products out of the active area. The fluid flow can be between a polar plate and a catalyst that enables the conversion of the carbon oxides and reactants into the valuable products. The plates are referred to as polar plates because they are associated with different polarities of the electrolyzer cell with the anode being associated with a positive polarity and the cathode being associated with a negative polarity. The fluid flow fields can be on both sides of the cells with one fluid flow field being associated with the cathode and another fluid flow field being associated with the anode. The fluid flow fields can be configured to accommodate gaseous or liquid phase fluids. For example, the cathode side may have fluid flow fields that accommodate gaseous phase fluids such as humidified carbon monoxide and the anode side may have fluid flow fields that accommodate liquid phase fluids such as an alkaline electrolyte with valuable products generated in a liquid phase (e.g., liquid phase carboxylate that can be isolated and converted to carboxylic acid).

The fluid flow fields can be part of a fluid path across the cell. The fluid path can include a fluid flow that is in contact with the electrodes and electrode catalysts of the cell. The fluid flow can be a gaseous fluid flow or a liquid fluid flow. The fluids can be reactants or electrolytes for the cell. For example, the electrode catalyst could be a cathodic catalyst and the fluid flow could be a gaseous cathodic feedstock flow. As another example, the electrode catalyst could be an anodic catalyst and the fluid flow could be an aqueous anodic feedstock flow.

An electrolysis cell in accordance with this disclosure can comprise an electrode assembly such as a MEA (Membrane Electrode Assembly) which is sandwiched against flow fields on either side to allow for the reduction and oxidation reactions that will produce the valuable products mentioned above by allowing for ions to pass through the membrane between the cathode and the anode. The flow fields can be configured in such a manner that the flow fields ensure both: (i) an electrical contact between the MEA and the polar plates of the electrolysis cell; and (ii) a fluid path for the transportation of reactants or products through the electrolysis cell. The MEA can include a membrane and zero, one, or two electrodes composed of a diffusion layer (e.g., porous media for enabling ionic transfer across the cell). The membrane, the electrodes, and the diffusion layer can include or be coated by a catalyst material. The anode side of the assembly can include an oxidation catalyst, and the cathode side of the assembly can include a reduction catalyst. Reduction and oxidation promoting catalysts are both referred to herein using the term electrode catalyst. In specific embodiments, each cell can include two assemblies with a separating area between them to allow for the removal of products that are designed to be kept separate from either the anodic of cathodic product or reactant streams. The cathodic input fluid flow through the flow fields can provide reactants that are electrochemically reduced. It may consist of, but not be limited to carbon dioxide, carbon monoxide, carbonate-, bicarbonate-containing solution, water in liquid or vapor form, argon, nitrogen, or water in the presence of dissolved salts. The anodic input fluid flow through the flow fields can provide the reactants that are electrochemically oxidized. It may comprise water in liquid form or in the presence of dissolved salts (CsOH, KOH, $CsHCO_3$, $Cs_2CO_3$, CsCl, CsBr, CsI, $KHCO_3$, $K_2CO_3$, KCl, KBr, KI, $NaHCO_3$, $Na_2CO_3$, NaCl, NaBr, NaI). The presence of ions in the fluid flow may also be beneficial to favor the ion-conducting activity of the membrane.

In keeping with the above description, a MEA for a carbon monoxide electrolyzer can be provided as an example. An MEA for a carbon monoxide electrolyzer cell can be characterized by: (i) a cathode comprising a porous electrode support (e.g., a gas diffusion layer (GDL)) and a carbon oxide reduction catalyst layer (integrated or deposited on the cathode material); (ii) an ion-conduction medium such as, but not limited to, one or more membranes, ion-conducting electrolyte, a diaphragm or oxide-conducting materials such as ceramics; and (iii) an anode layer comprising an oxidation catalyst that promotes oxidation of a reactant (e.g., water). While the example of a carbon monoxide electrolyzer is used throughout this disclosure, embodiments disclosed herein are equally applicable to alternative electrolyzers which use flow fields and MEAs more generally.

A plurality of electrolyzer cells can be arranged in different configurations in an electrolyzer. When the electrolyzer cells are arranged in series, such an electrolyzer reactor configuration can be referred to as an electrolyzer stack. In that case, the anode (at which an oxidation reaction occurs) of a cell is electrically connected to the cathode (at which a reduction reaction occurs) of the subsequent cell and so on. Electrolyzer cells may have various geometric shapes including, but not limited to, circular or polygonal. The geometric shapes can be rectangular, square, pentagonal, hexagonal, and octagonal. In the case of an electrolysis stack, similar or different shapes may be adopted for the other elements of the stack.

The polar plates of the electrolyzer stack can be configured in various ways. The plates can ensure mechanical support for the electrolyzer cells, serve as electronic conductors for the stack, and can also play a role in distributing fluid through the electrolyzer cells to introduce and remove reactants and products to the electrolyzer's active area. In specific embodiments, consecutive MEAs in an electrolysis stack are physically separated by bipolar plates (BPPs). The BPPs can also ensure an electrical connection in series between subsequent MEAs. Plates can include flow fields and fluids ports for each electrolysis cell in the stack. In the case of a stack that uses BPPs, at the end of the stack, only one side of the plate is in contact with the terminal MEA. Such a plate can be referred to as a monopolar plate.

An electrolyzer stack can be configured in various ways. At the extremities of the stack, current collectors can allow for connection to an external power supply. The stack can be assembled within a stack casing composed of end plates that allow for mechanical support, ensure electrical isolation, and provide the fluids ports (inlet/outlet) for both the reactants and products streams. The stack can include a means for compressing the stack to prevent fluid leaks in the system. For example, the stack can be compressed to form seals with gasket material that is placed between the various layers of the stack. As disclosed herein, the gaskets can be loose gaskets which are not shaped to adhere to features of the stack while still providing sufficient seals for the operation of the electrolyzer stack.

FIG. 1 is an exploded diagram of electrolyzer stack 100 in accordance with specific embodiments of the inventions disclosed herein. As illustrated, electrolyzer stack 100 includes first end plate 101 and second end plate 102. The stack also includes various gaskets 103*a*, 103*b*, 103*c*, and 103*d* dispersed within the layers of electrolyzer stack 100 to prevent leaks and to provide for electrical isolation between cells. First end plate 101 and second end plate 102 can be compression plates that are tightened together to compress the gaskets to form seals. The gaskets include cutouts for inter-cell fluid interfaces 104 to allow for fluids to flow through the cells of the stack. There are four interfaces in the inter-cell fluid interfaces 104 to allow for a fluid inlet and fluid outlet for each of the two polar sides of the illustrated cells. Electrolyzer stack 100 also includes two illustrated bipolar plates (bipolar plate 105*a* and bipolar plate 105*b*). The plates include channels (either tunnels or trenches) to allow fluid to transfer from the inter-cell fluid interfaces to the active area of the cell. The active area is coextensive with membrane-electrode assembly 108. The gaskets also include central cutouts that are coextensive with the active area, such as cutout 109, to allow for fluids that are channeled by the plates to reach membrane-electrode assembly 108. To simplify the diagram, not all elements of the stack are illustrated. For example, many cells are represented by stack 107.

In specific embodiments, a frame can be added to the top of an electrolyzer stack to provide for hermeticity with the gaskets on the top plate of the stack. Such a frame can be a rigid plastic frame. In specific embodiments, the frame can be placed around the periphery of two compression plates on either side of the stack.

The plates described in this specification, such as bipolar plate 105*a* and bipolar plate 105*b*, can be made of stainless steel (notably but not limited to 316L), titanium, graphite or any conducting material. The plates may comprise one or more surface coatings (comprising e.g. Ti, Cr, Nb, Ni, Fe) on one or more faces in contact with one or more MEAs to minimize contact resistance and improve chemical resistance (notably to corrosion). While the plates in FIG. 1 include cutouts for the inter-cell fluid interfaces, in alternative embodiments the fluid interfaces might not extend through the polar plates and may instead be formed on the edges of the polar plates. In specific embodiments, each cell in the stack can contain an additional cell frame (not pictured), that is, a frame surrounding the electrochemical cell between two polar plates. In some variants, fluid interfaces may extend partly or fully through the cell frame. In specific embodiments with additional cell frames, polar plates may be flat metal sheets, where a single cell frame contains input and output fluid interfaces for both the anode and cathode side of the cell. While all the plates in FIG. 1 are rectangular and are all uniform in shape, in alternative embodiments the plates may have different shapes such as circular or triangular plates and there may be variation in the shapes within a given stack.

Figure 2:
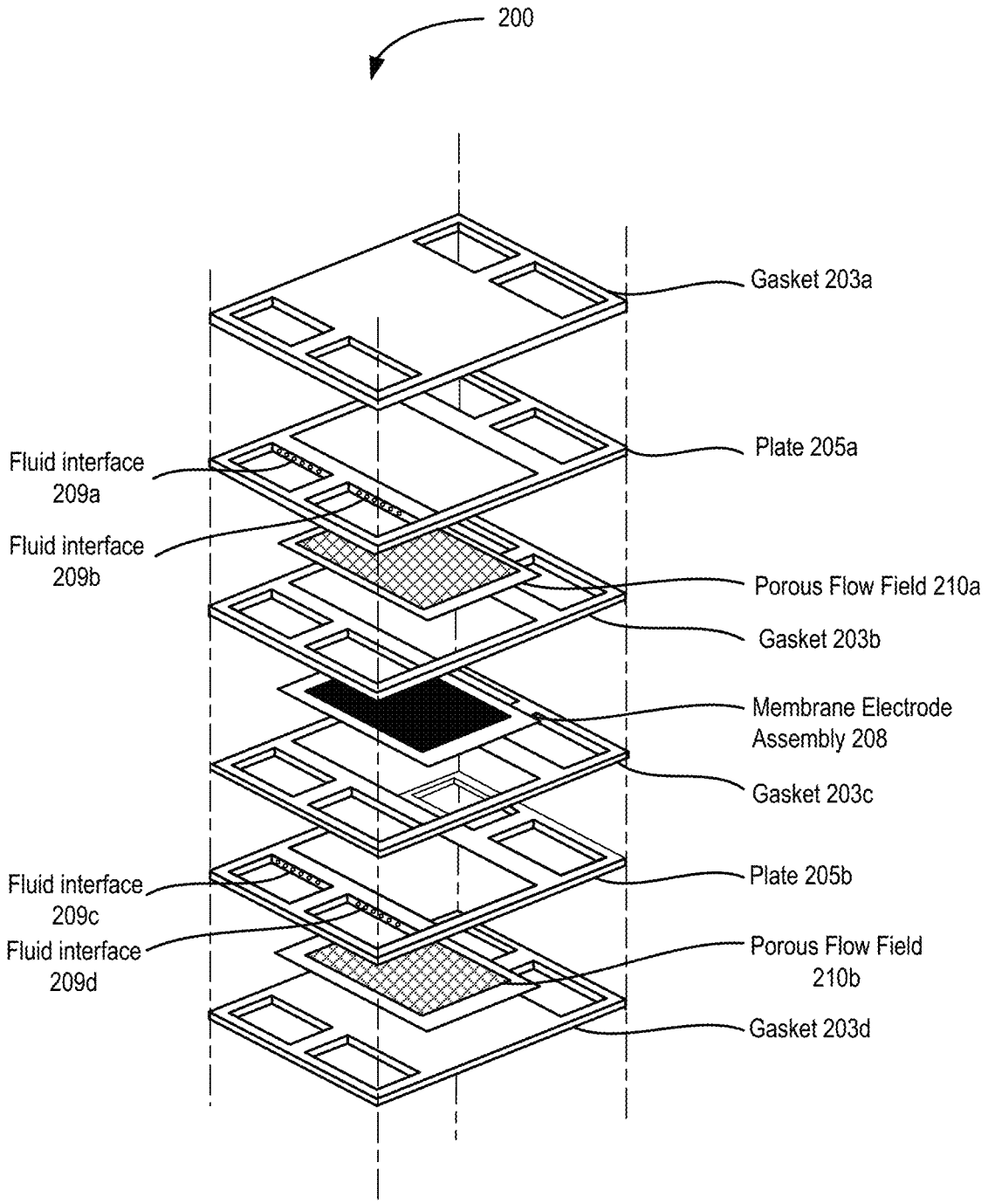
FIG. 2 is an exploded diagram of an electrolyzer cell in accordance with specific embodiments of the inventions disclosed herein.

FIG. 2 is an exploded diagram of electrolyzer cell 200 in accordance with specific embodiments of the inventions disclosed herein. Electrolyzer cell 200 includes two bipolar plates (bipolar plate 205*a* and bipolar plate 205*b*). The plates include fluid interfaces (fluid interface 209*a*, 209*b*, 209*c*, and 209*d*) which channel fluid to and from the inter-cell fluid interfaces to and from the active area of the cell. These fluids can then come into contact with either side of membrane electrode assembly 208 and they are kept from leaking by gaskets 203*a*, 203*b*, 203*c*, and 203*d*. Membrane electrode assembly 208 can include one or two electrodes, each with an electrode catalyst, that are separated by a membrane or separator. The cell also includes porous flow field 210*a* and porous flow field 210*b*. In the illustrated case, the flow fields are formed by compressible electrically conductive meshes that are the same shape as the active area of the electrolyzer cell, and the polar plates do not include any flow fields etched into them through machining or any other means. This provides significant benefits in terms of the manufacturability of the overall electrolyzer stack because the step of creating intricate patterns into the polar plates as in other approaches can be skipped. In alternative embodiments, the polar plates can have flow fields patterned into them, or an alternative structure can form flow fields in the active area. In these embodiments, the flow fields can be filled with a compressible electrically conductive material that will serve a similar purpose to the single compressible electrically conductive mesh in the embodiment of electrolyzer cell 200.

As mentioned previously, the gasketing system of an electrolyzer stack serves several purposes. To preserve efficiency and ensure good operation of the electrolyzer, two consecutive plates should not be in direct ohmic electrical contact. The passage of current from one plate to the next should ideally be exclusively insured by the transport of ions through the central membrane of the MEA to minimize current leakages between subsequent cells and maximize the energy efficiency of the reaction occurring at each electrode of the MEA. A gasketing system can prevent contact between adjacent plates for this purpose. Furthermore, the use of an ion-containing solution, such as, but not limited to, an ion-containing aqueous solution at the anode, creates an electrical contact between two adjacent polar plates and may lead to current leakages. A gasketing system can reduce the impact of, or eliminate, these leakage currents. Furthermore, a gasketing system may be composed of gaskets that are applied at the interface between the MEAs and BPP as well as around the inter-cell fluids ports to provide hermeticity to the fluids compartments. The gaskets can be made of a single piece or several separate pieces and be placed around both the electrochemically active areas and the fluids ports.

Based on the requirements of the gasketing system, the system is required to meet certain design constraints. In specific embodiments, the gasketing system may need to work in parallel with parts of the electrolysis cells such as the gas diffusion layer (GDL) of an MEA, hence inducing some design constraints. Among the design constraints placed on the gasketing system, the gasketing system should be operated in a compression range window that ensures both hermeticity of the electrolyzer reactor and good compression of the GDL. The gasketing system should also be mechanically stable to avoid creep deformation. In general, the compression of the cell's active surface should be within its optimal operating window to ensure: proper electrical contact between the plate and the components of the MEA (e.g., a GDL); contact allowing for the exchange of different species between the electrodes and other components of the MEA (e.g., between the electrolyte and GDL); sufficient porosity of the diffusion layer which connects the flow field with the electrodes (e.g., the GDL) to ensure the transport of reactants and products of electrochemical reactions; and hermeticity of the assembly.

In general, a loose gasket applied on a plate's flat surface will have a narrow acceptable compression range. As a result, shaped, and thereby more expensive gaskets are usually preferrable. Due to variations in component properties during compression, it is likely that, in some cases, sealing will not be achieved, or the compression of the active area will be too high, leading to the insufficient transfer of chemical or ionic species through the MEA. However, using a flow field formed by compressible porous mesh material, it is possible to use a flat surface plate and a loose gasket to ensure the above listed objectives of a gasketing system are achieved while also providing the optimal compression of the cell's active surface. Hence, the use of an electrically conductive mesh as a compressible porous material to form the flow fields of an electrolyzer allows for design simplification and cost savings in terms of both the gasketing system and the design of the plates for the electrolyzer stack.

In specific embodiments, a loose gasket is placed in contact with the flat surface of a bipolar plate and exhibits a minimal deformation range for achieving the desired objectives listed above. In these embodiments, the traditional flow field is replaced by a flow field formed by compressible porous material such as a porous metal or expanded metal mesh. The resulting system will meet the compression constraints of the components in the active area of the cell while enabling the use of a flat and relatively inexpensive plate and a loose gasket placed in contact with the plate. Thus, the plate can be flat or simplified and will have flat seals on both sides. Internal cutout of the gaskets can accommodate the mentioned electrically conductive compressible porous material, which will serve as the flow field. The compressibility of the porous material used as the flow field will absorb the cumulative effects of geometric variations, tolerances, and different elements, while still adhering to the mentioned constraints above. Flow fields that are formed by electrically conductive compressible porous mesh can ensure proper ionic conductivity through the electrolyzer, proper flow of electrolyte, products, and reactants through the flow fields, and homogenous compression of the MEA.

Figure 3:
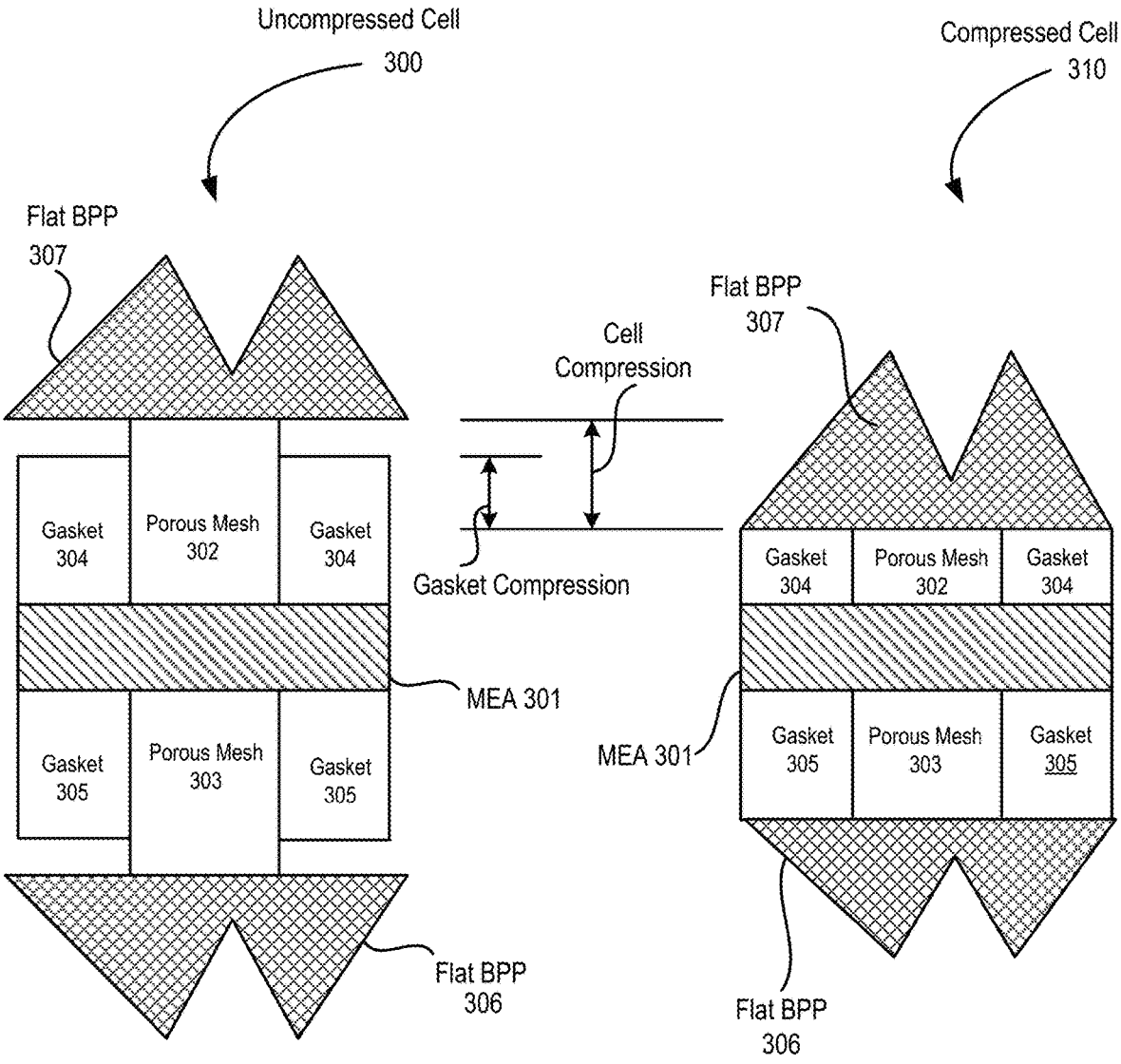
FIG. 3 includes a cross section of an electrically conductive compressible porous material in an uncompressed cell and a cross section of the same electrically conductive compressible porous material in a compressed cell in accordance with specific embodiments of the inventions disclosed herein.

FIG. 3 includes a cross section of an electrically conductive compressible porous mesh 302 (e.g., a material) in uncompressed cell 300 and a cross section of the same electrically conductive compressible porous mesh 302 in compressed cell 310 in accordance with specific embodiments of the inventions disclosed herein. The electrically conductive compressible porous mesh 302 is surrounded by gasket 304 that brackets the electrically conductive compressible porous mesh 302 in the illustrated cross section and surrounds the electrically conductive compressible porous mesh 302 in a top-down view. The electrically conductive compressible porous mesh 302 is on MEA 301. The electrically conductive compressible porous mesh 302 can provide an ohmic connection between a polar plate such as BPP 306 and an electrode catalyst on MEA 301. The ohmic connection can be in the plane of the cross section in FIG. 3. The electrically conductive compressible porous mesh 302 can present a set of holes to the electrode fluid inlet of the cell. The set of holes can have a larger surface area in the compressed electrically conductive mesh as compared to an uncompressed surface area of the set of holes. Regardless, the electrically conductive compressible porous mesh 302 can provide for a fluid flow through the presented holes from the fluid inlet to a fluid outlet through the electrically conductive compressible porous mesh 302. The electrically conductive compressible porous mesh 302 in FIG. 3 is bordered on two sides by gasket 304 and on a third side out of the plane of the page by an electrode fluid inlet and on a fourth side opposite the third by an electrode fluid outlet.

The figure includes a second electrically conductive compressible porous mesh 303 which is similarly situated to gasket 305 as gasket 304 is situated relative to electrically conductive compressible porous mesh 302. The electrically conductive compressible porous mesh 302 and electrically conductive compressible porous mesh 303 can be formed by electrically conductive compressible foam or an otherwise structured mesh of conductive material.

The electrode catalyst on the side of MEA 301 that faces conductive compressible porous mesh 302 (e.g., that faces a porous flow field thereof) can include a gas diffusion layer with a cathode catalyst material. BPP 307 (e.g., a polar plate) can be a cathodic polar plate. The electrode fluid inlet that borders electrically conductive compressible porous mesh 302 outside the plane of the page on one side can be a cathodic fluid inlet and the electrode fluid outlet that borders electrically conductive compressible porous mesh 302 outside of the plane on the other side can be a cathodic fluid outlet. The electrode catalyst on the side of MEA 301 that faces electrically conductive compressible porous mesh 302 can be a cathodic catalyst. BPP 306 (e.g., a polar plate) can be an anodic polar plate. The catalyst on the side of MEA 301 that faces electrically conductive compressible porous mesh 303 (e.g., that faces a porous flow field thereof) can be an anodic catalyst. The electrode fluid inlet that borders electrically conductive compressible porous mesh 303 outside the plane of the page on one side can be an anodic fluid inlet and the electrode fluid outlet that borders electrically conductive compressible porous mesh 303 outside of the plane on the other side can be an anodic fluid outlet. MEA 301 can include an ionically conductive separator located between the anodic catalyst and the cathodic catalyst. Electrically conductive compressible porous mesh 303 can be the second positioned to allow an anodic fluid flow from the anodic fluid inlet to the anodic fluid outlet.

The cell can transition from the uncompressed state to the compressed state through the application of force towards the center of the cell as imparted by a first compression plate and a second compression plate that is fastened to or otherwise pressed towards the first compression plate. The electrically conductive compressible porous mesh can then be compressed by the first compression plate and the second compression plate. In the illustrated case, the flow fields on either side of the cell are formed by the electrically conductive compressible porous mesh, but in some embodiments only one side can utilize flow fields formed in such a manner.

In FIG. 3, MEA 301 is surrounded by two GDLs that span from left to right across the cross section and are not separately illustrated in the diagram. Electrically conductive compressible porous mesh 302 forms a porous flow field that is in contact with one of the two GDLs. Electrically conductive compressible porous mesh 303 forms a porous flow field that is in contact with the other of the two GDLs. In uncompressed cell 300, the cell is uncompressed. In compressed cell 310, the cell is compressed by pressure applied towards the center of the cell via BPP 307 and BPP 306. In the compressed configuration, the electrically conductive compressible porous mesh 302 can be a compressed electrically conductive mesh which provides a fluid path from the electrode fluid inlet of the cell to the electrode fluid outlet of the cell through the compressed electrically conductive mesh. The fluid flow would be into the plane of the page in FIG. 3. In the illustrated case, BPP 307 and BPP 306 are flat plates that do not include flow fields or any features patterned into them. The cell is therefore easier to manufacture than those which use bipolar plates having features that are designed to form flow fields or accommodate shaped gasketing material.

In alternative embodiments, the surface of the plates can include channels and complex flow field patterns. Any of these flow field patterns can be used in combination with pieces of electrically conductive compressible mesh that are formed to fit into the flow field pattern or a single shaped piece of electrically conductive compressible mesh that is formed to fit into the flow field pattern. Any of these flow field patterns can be used with a loose gasket where a cutout of the gasket includes the flow field pattern such that the loose gasket includes a negative of the flow field pattern. In specific embodiments, the loose gasket can be replaced by a gasket that is secured to the edges of the plate while still exhibiting the patterns disclosed herein.

As illustrated, the cell is compressed to a certain degree with the label cell compression where the porous flow field is compressed by the cell compression distance and the gasket is compressed by less than the cell compression distance. Such a design in which the porous flow field mesh is taller than the gasketing in the uncompressed cell allows for the compression of the gasket to define the degree by which the cell is compressed. Since the compression of the gaskets to a desired degree is what sets the hermeticity of the cell and provides all the other benefits mentioned above, such a configuration is desirable. As illustrated, the electrically conductive compressible porous mesh 302 extends from the MEA 301 to the BPP 307 thereby providing a conductive pathway between the bipolar plate and the electrode of the MEA 301. Having the porous flow field start at a larger thickness than the gasket material also assures that the contact between the plate and the porous flow field is good enough for this conductive pathway. In specific embodiments of the invention, the material that forms the porous flow field, such as a compressed electrically conductive mesh, can be compressed to between 20% and 40% of an uncompressed volume of the compressed electrically conductive mesh. This degree of compression in some embodiments assures that the porous flow field provides a desired degree of electrical conductivity and stability in cooperation with the gasket while at the same time assuring that the pores are not collapsed to the point that they can no longer allow for fluid to easily flow through the mesh.

Figure 4:
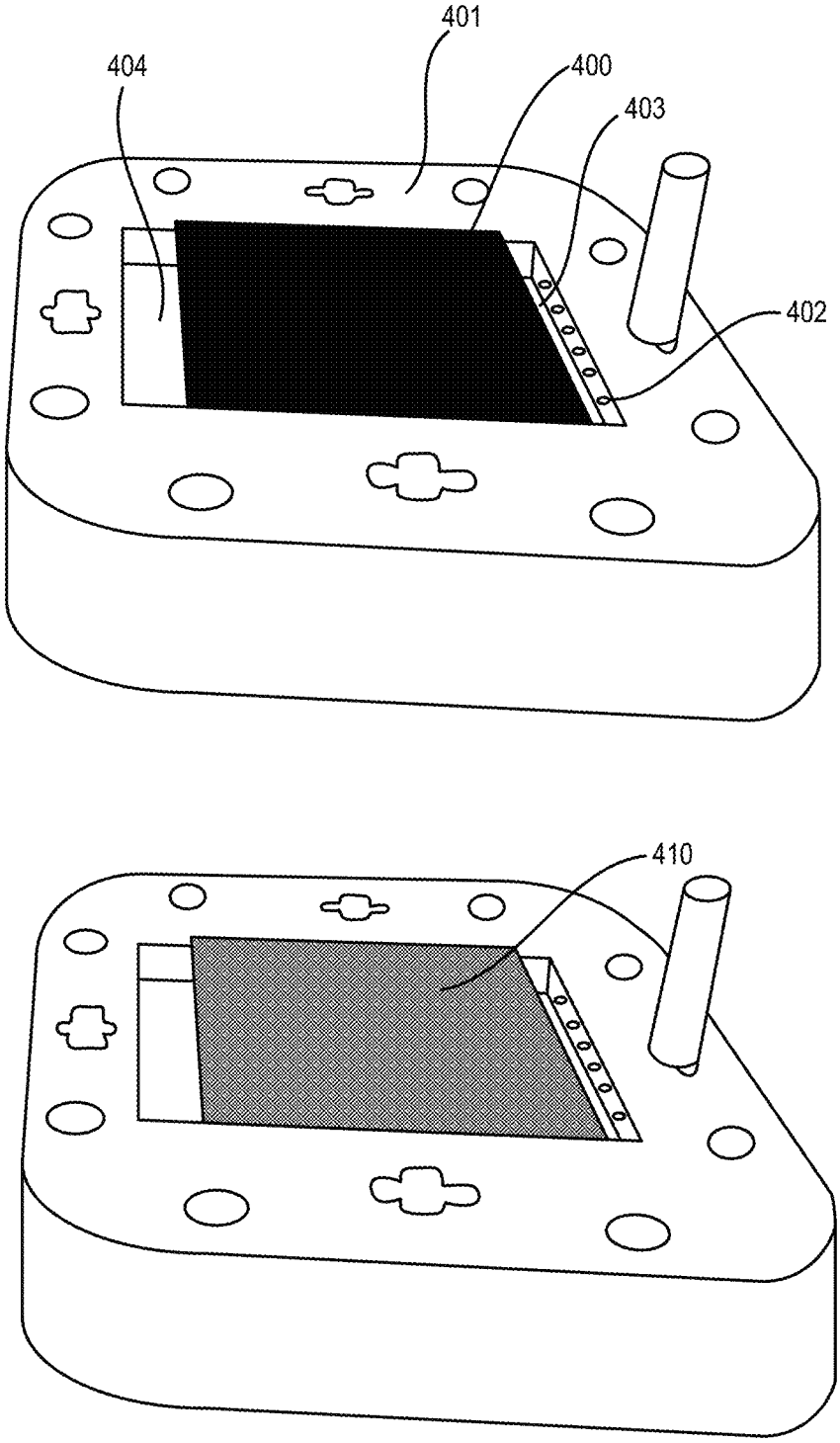
FIG. 4 illustrates a polar plate in an electrolyzer cell and the same polar plate with a conductive mesh placed on the polar plate in accordance with specific embodiments of the inventions disclosed herein.

FIG. 4 illustrates polar plate 400 in an electrolyzer cell and the same polar plate 400 with a conductive mesh 410 placed on polar plate 400 in accordance with specific embodiments of the inventions disclosed herein. The illustrated electrolyzer cell includes a compression plate 401 that can be used to compress the electrolyzer cell in combination with another compression plate on the other side of the cell. As illustrated, compression plate 401 includes a set of tunnels 402 that connect the active area of the cell with the inter-cell fluid connections of the stack. The active area of the cell is bracketed by electrode fluid inlet 403 and electrode fluid outlet 404. The fluid that arrives in the active area can flow through conductive mesh 410 to the alternative side of the cell and be removed via tunnels in the alternative side of compression plate 401 which are not visible in the figure due to the angle, but that are generally in concordance with set of tunnels 402.

Figure 5:
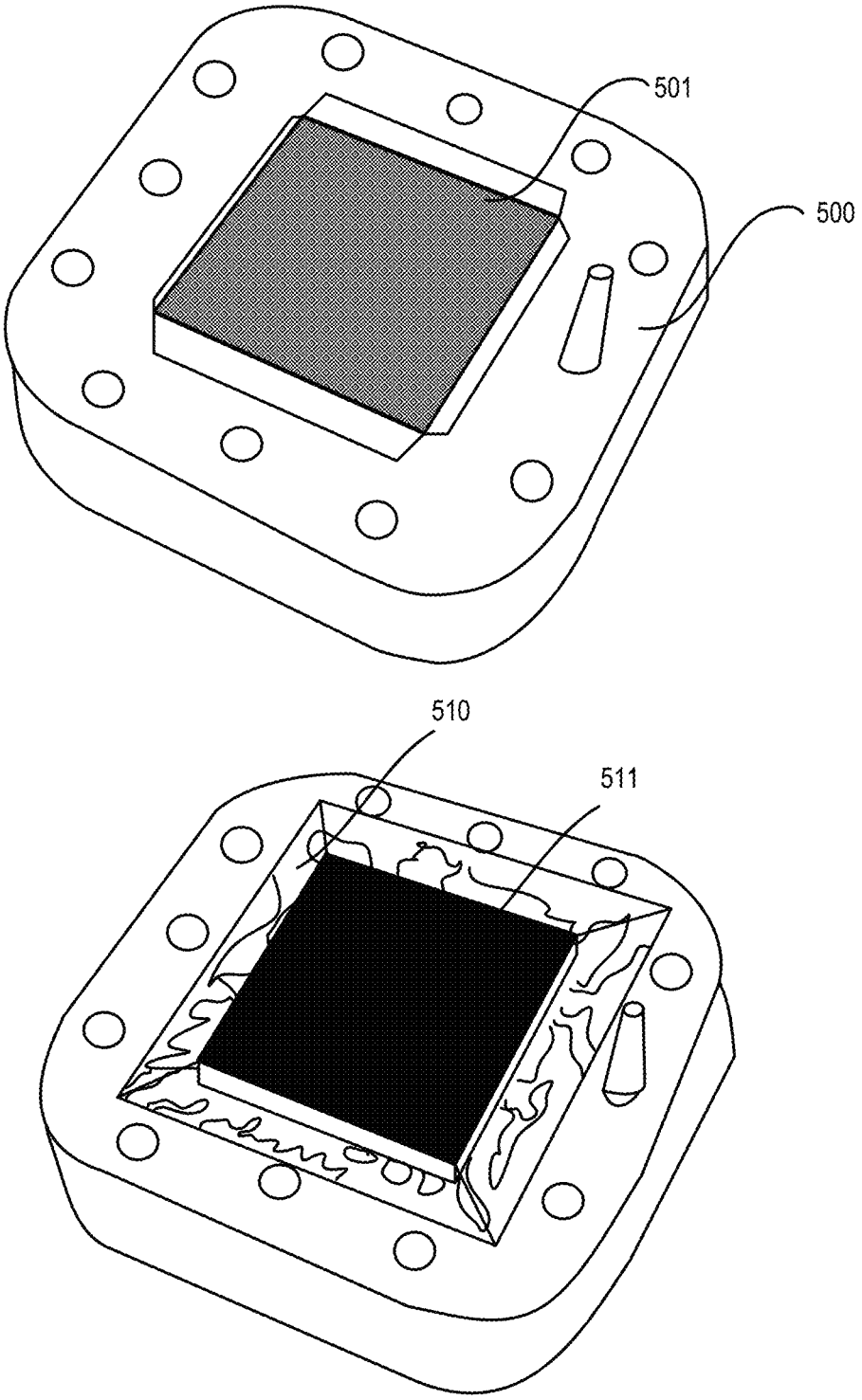
FIG. 5 illustrates a polar plate in an electrolyzer cell with a gasket placed on the cell and the same polar plate with a membrane assembly placed on the gasket in accordance with specific embodiments of the inventions disclosed herein.

FIG. 5 illustrates a polar plate (such as polar plate 400) in an electrolyzer cell with gasket 500 placed on the cell and the same polar plate with an MEA 510 placed on the gasket in accordance with specific embodiments of the inventions disclosed herein. As illustrated, gasket 500 prevents fluid leaking out between the compression plate and MEA 510. Gasket 500 includes cutout 501 over the active area which allows fluid to flow in an unobstructed manner through the porous flow field and in contact with MEA 510. However, as illustrated, MEA 510 includes central area 511 with the electrodes and catalysts of the device but extends beyond the active area and fluid channels of the compression plate in order to prevent leakage around the flow fields or out of the cell.

The electrically conductive compressible porous mesh in accordance with this disclosure can take on various forms. The electrically conductive compressible porous mesh can be stainless steel (notably but not limited to 316L), titanium, graphite, aluminum, nickel, a nickel-chromium-based alloy, or any conducting material; plates may comprise one or more surface coatings (comprising e.g., Pt, Au, Ti, Cr, Nb, Ni, Fc). The material can form a conductive mesh or electrically conductive porous foam. The mesh can form a structured grid or an amorphous foam. The electrically conductive compressible porous mesh can include a coating. The coating can be one of gold, nickel, and platinum. Some materials can be chosen to match the proper environment. For example, in a carbon oxide electrolyzer, nickel can be chosen as an anode material for a conductive mesh or a gas diffusion layer. Nickel can act by itself as a proper catalyst at the anode for this reaction, or it can also be coated with Ir as an additional catalyst. However, nickel should not be used for certain reactions on a cathode; when electrolyzing CO, nickel at or near the catalyst surface can create toxic nickel carbonyls and should be avoided.

Flow fields that are formed by electrically conductive compressible porous meshes in accordance with this disclosure can be referred to as porous flow fields. The porous flow fields can be pressed onto the plates of the electrolyzer cell and can be held in place by the compression of the cell. Alternatively, the porous flow fields can be adhered to the plate such as by welding the porous flow field to the plate. The porous flow field can be adhered to the plates on the sides of the flow field pattern (e.g., around the periphery of the flow field pattern) or continuously throughout the flow field pattern. The porous flow fields can be made of an electrically conductive mesh or electrically conductive porous foam.

The porous flow fields can be designed subject to specific design constraints. The material, pore size, and compressibility of the porous flow fields can be selected to allow for compression of the flow fields uniformly with a gasketing system, the formation of a flow field with minimal fluid pressure, and the formation of an ohmic connection across the flow field with a sufficiently low resistivity. Generally, the pores in the flow field can be sized to allow sufficient flow of the electrolyte, reactants, or products of the electrolyzer cell through the flow fields. In specific embodiments, the pores can be 0.5 mm in diameter. In specific embodiments, the pores can be on the range of 0.1-2 mm in diameter. An increase in pore size can result in a decrease in the conductivity of the porous flow field and therefore an increase in the resistivity of the electrolyzer cell. However, a decrease in pore size can result in an increase in the pressure required to push reactant or electrolyte fluid through the porous flow field which can also degrade the performance of the device by leading to a nonuniform field of flow and an increased potential for leaks and other problems due to the increased pressure required for the system to function. As written here, "pore size" refers to the average size of a volume surrounded by conductive material. In general, pores in a porous flow field are open pores to allow fluid communication between fluid inlets, outlets, and the MEA. The amount of conductive material by volume can be relatively low compared to the volume of the open pores, but the pore size dimension can be measured by examining features of the conductive material framework that at least partially surround an open volume.

Figure 6:
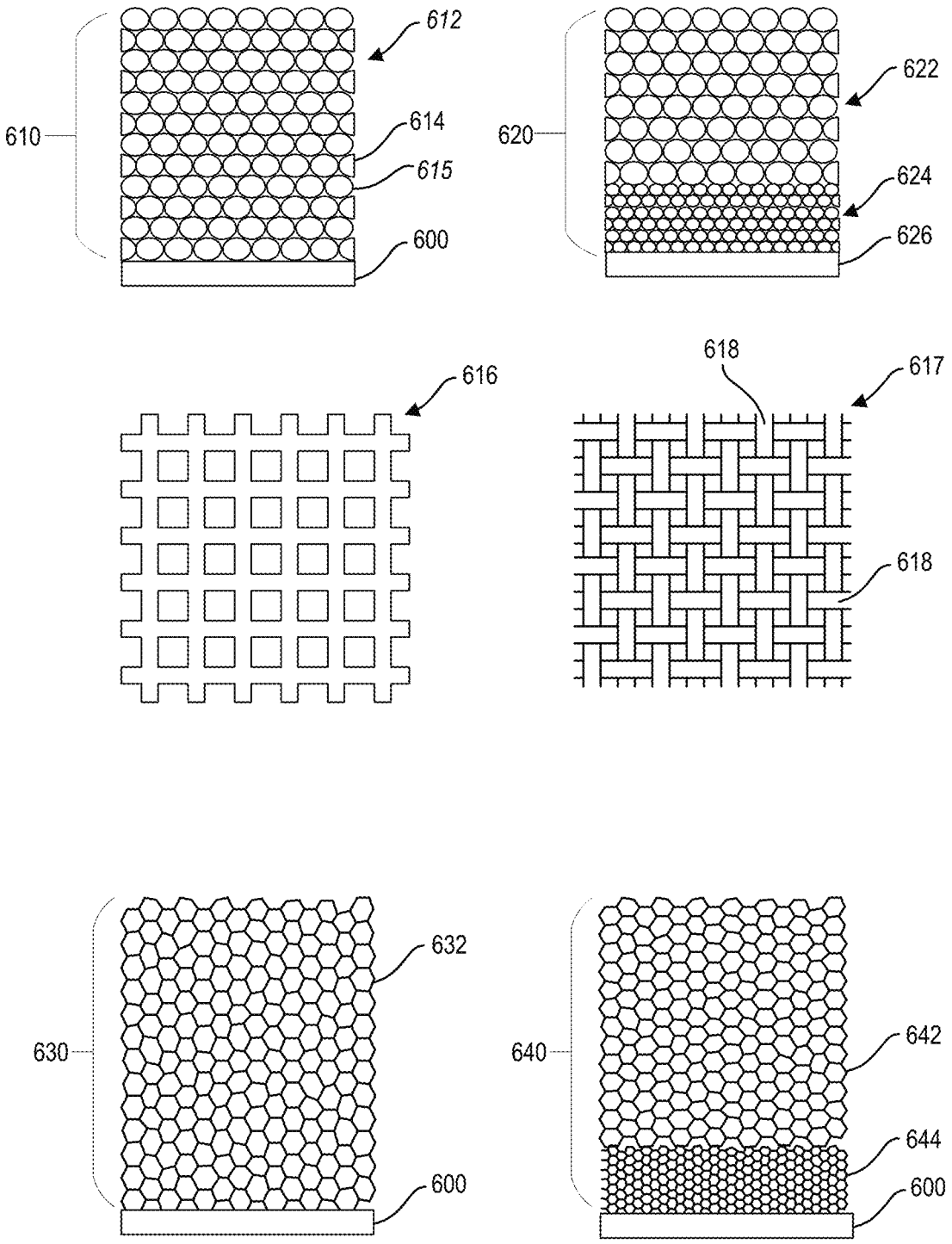
FIG. 6 illustrates various configurations of electrically conductive compressible porous meshes in accordance with specific embodiments of the inventions disclosed herein.

Many variations are possible for structures and materials of porous flow fields depending on the electrolyzer reactants and products. As mentioned previously, a porous flow field mesh can be an electrically conductive foam or can be an electrically conductive structured mesh. FIG. 6 shows some examples of conductive mesh configurations along with some associated attached structures according to specific embodiments of the invention. Note that the examples as depicted in FIG. 6 are not intended to show the specific shapes or layouts of pores, but rather to illustrate the relative sizes and positions, including one or more various layers that can be present, and show various embodiments of mesh structures. Conductive mesh structure 610 is an example of a portion of mesh 612 in contact with electrode 600.

Conductive mesh structure 610 can be part of porous mesh 302 or porous mesh 303 of FIG. 3. Electrode 600 can be a GDL electrode corresponding to the upper surface of MEA 301 or could otherwise be a porous electrode that could correspond to the aqueous anode side of MEA 301. Conductive mesh 612 shows a number of porous cells that are substantially the same size. Mesh 612 shows significant internal structure and can be created, for example, by using expanded metal, flat metal grids, woven fiber grid of metal or other materials such as carbon fibers.

One example of a flat grid is grid 616, which shows a top view of one layer that can be stacked. The grids can be layered to form the mesh, for example, individual horizontal layers 614 and 615 can be patterns such as grid 616; grid 616 shows a square pattern, but holes in the grid may have an arbitrary shape or size; in some variants, different patterns can be used for consecutive layers. Successive layers such as 614 and 615 can be aligned so that their holes align over each other but can also be translated so that the hole structures only partially overlap. The individual layers can be in rotational alignment, but alternatively they can be rotated so that the patterns do not overlap. A structure where the various layers do not precisely overlap can promote mixing of fluids traversing through a mesh by encouraging turbulent flow. In addition, some types of meshes, such as for example, expanded metal meshes, can have less flow resistance in one direction as compared to another. Rotation of layers, even those with similar pore sizes, can also increase turbulent flow (as opposed to laminar flow). Another example is of a woven grid 617. Individual fibers of metal, carbon fibers, or other materials may be interwoven to create a layer structure. Various sizes of fiber 618 can be chosen as well as their spacing to select the effective pore size of a layer stack of conductive mesh 612. Similarly to the previous example, layers 614 and 615 can be grids (like woven grid 617), with similar variation of translation and rotation of various constituent layers. In specific embodiments, layers can be attached together by welding or sintering. Alternatively, layers may be left unattached but can come into firm electrical contact when the entire structure is assembled and compressed.

In another example, conductive mesh structure 620 comprises two or more structured layers of mesh placed in contact with electrode 626. Mesh 622 can have one average pore size, and mesh 624 can have a different pore size. Though only two mesh layers are shown, a plurality of different mesh layers may be present. In specific embodiments, the pore size of the layers can decrease monotonically from the top side of the mesh layers (in this example the top of mesh 622 oriented toward a polar plate) toward the lower layers connecting to electrode 626. Structured mesh layers may comprise substantially the same material or can comprise different materials. Each mesh layer such as mesh 622 may also exhibit similar structures as previously described for mesh 612. Meshes with multiple pore sizes may have some advantages over those with single pore sizes. Larger pore sizes near polar plate inputs allow freer flow of incoming reactants as well as outgoing products. One or more additional layers with decreasing pore sizes create turbulence in the flow.

Conductive mesh structure 630 is similar to mesh structure 610, except that mesh 632 is irregularly structured or amorphous; in this case, the average pore size can have a distribution of sizes where the sizes are similar throughout mesh 632. Mesh 632 can be a metal foam or can be a foam of a different substance such as an expanded graphite foam. Mesh 632 can also comprise a polymer structure where graphite has been mixed into the monomer mixture before the foam is created. The mesh can also be formed from carbon powders where the gaps between powder particles act as pores through the structure.

Conductive mesh structure 640 is similar to mesh structure 620 in that multiple layers with different pore sizes are present, but like mesh 632, meshes 642 and 644 are irregularly structured or amorphous, and can comprise foams or other structures as previously described. Mesh structure 640 depicts two meshes 642 and 644 (e.g., mesh layers), but a plurality of mesh layers can be present. In some cases, irregularly structured meshes can be formed by joining two different structures, for example two metal foams with different pore sizes (and possibly compositions). Metal foams can be formed using known techniques, such as gas injection into metal powders, or metallization of polymer foams. In other cases, the whole structure 640 could be metallized together, where multiple layers of polymer foam, for instance, polyethylene, can be placed in contact with one another, and then all are metallized together similar to processes used for a single layer of polymer foam. In specific embodiments, amorphous conductive meshes can be created with a more continuous variation in pore size. Polymer foams can be created where there is a gradient of pore size along a particular axis in the foam. A single layer of foam with a generally continuous gradient of pore sizes can be similarly metallized to create a foam with larger to smaller pore sizes and oriented along a depth direction from the polar plate to the MEA.

In specific embodiments, the gas diffusion layer electrode can be merged with the conductive mesh layer and placed directly in contact with the membrane. One common GDL electrode on the cathode side consists of hydrophobized carbon fiber paper that has been treated with a layer of copper to form copper nanoparticles at the surface. The copper nanoparticles have a high surface area and act as a cathode catalyst when placed in contact with the membrane. In addition, the carbon paper can act as a barrier that prevents some species that diffuse through the membrane from touching other portions of a conductive mesh. For example, stainless steel can be an effective mesh, but may also lead to undesirable side reactions if portions of the reactive species migrate to the stainless steel layer. As an alternative to the separate layer formed on carbon, carbon nanoparticles could be created directly on the bottom surface of the mesh. In some cases, a layer of copper can be formed, for example through electroplating, vapor deposition, or other methods; following this, copper nanoparticles can be formed at the surface. In some embodiments, a layer of copper foam can be attached (welded, sintered, or compressed) to the bottom of the conductive mesh before functionalizing it with copper nanoparticles.

Conductive meshes have been used as replacements for flow fields patterned in polar plates for certain applications where the type of material is balanced for the anode and cathode. For example, in a PEMWE (proton-exchange membrane water electrolyzer), both anode and cathode have an aqueous fluid on their side of the membrane. As another example, hydrogen fuel cells with a PEM have gaseous input on both anode and cathode. In this application, water evolved from the reaction can be quickly wicked away from the membrane using a conductive mesh, which can be used on both sides to facilitate mixing and transport of the reactants. However, these structures have not previously been used in carbon oxide electrolyzers or other electrolyzers where one side, such as the cathode, uses a GDL with gaseous input, and the other side, such as the anode, uses an aqueous or other liquid flow on the membrane. These have not been used because of the various pressure differentials required to make the electrochemical cells functional and efficient.

For example, in a carbon oxide electrolyzer, a pressure differential can be used between the cathode and the anode side of the membrane to prevent liquid leakage into the cathode area. In some cases, the pressure difference can be 800 mbar or more, where higher pressure on the cathode allows operation of the electrolyzer with little or no water leakage onto the cathode catalyst. Water at the cathode side can produce hydrogen gas, which is often undesirable for many reaction products such as ethylene and lowers the efficiency of the cell. In some configurations, the pressure differential can be finely tuned between the two sides so that the liquid/gas interface position can be controlled to be very near the cathode catalyst for optimal conversion ratios while also minimizing water leakage. Another type of pressure in these systems is mechanical pressure on the cathode electrode. Pressure on the liquid anode side is necessary to prevent leakage and bring elements into contact, but the tolerance on pressure here is wider as ionic flow of reactants to the anode catalyst is facilitated by the aqueous solvent. On the cathode side, all flow is gaseous, and so it is much more critical that the cathode catalyst be in close contact to the separator membrane, especially when the liquid interface only extends right to the cathode catalyst. To achieve this close contact over the entire surface, pressure pushing down on the gas diffusion layer can be as high as 1 MPa.

Figure 7:
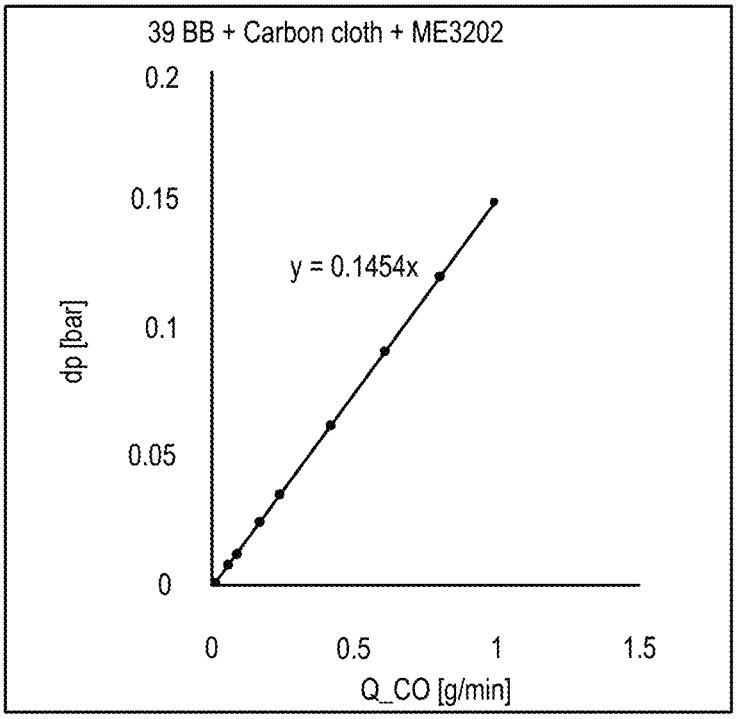
FIG. 7 includes two plots showing the fluid resistances of two compressed electrically conductive meshes in accordance with specific embodiments of the inventions disclosed herein.
Figure 7:
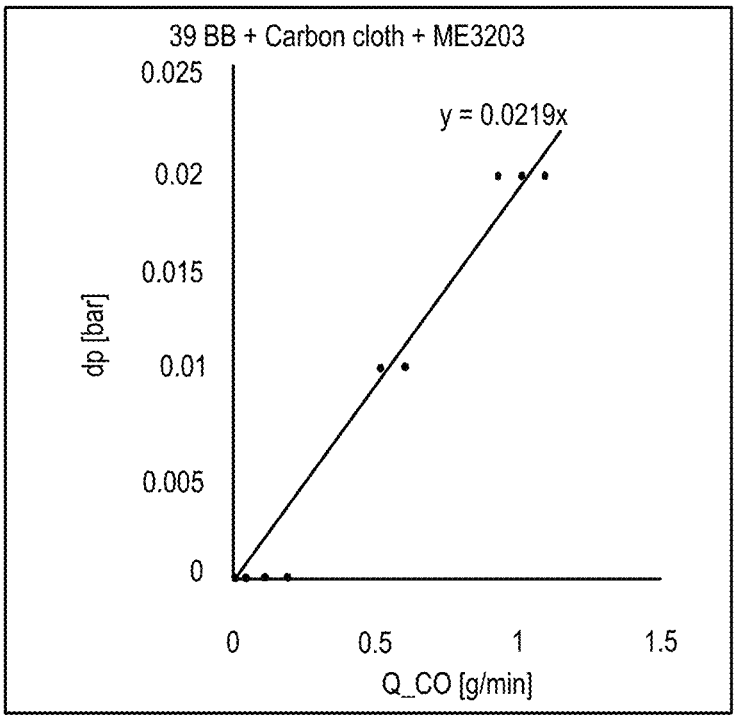

FIG. 7 includes two plots showing the fluid resistances of two compressed electrically conductive meshes in accordance with specific embodiments of the inventions disclosed herein. As stated previously the size of the pores can impact both the pressure required to push reactants or electrolyte through the flow field and the electrical conductivity of the porous flow field. Additionally, the height of the mesh in the direction perpendicular to the direction of fluid flow will have an impact on both of those factors in a similar fashion in that an increase results in a decrease in resistance to fluid flow and an increase in electrical resistance. In these figures, the fluid resistances are calculated using the formula deltap=$K \times Q_m$ where $Q_m$ is the mass flow rate of carbon monoxide being supplied to the electrolyzer and deltap is the pressure drop on the anolyte side. As illustrated, for a thin mesh of 0.2 mm thickness and 7.1 mm width and length, the fluid resistance K is 0.1454 bar/(grams/minute) while for a thick mesh of 0.9 mm and 7.1 mm width and length, the fluid resistance K is 0.0219 bar/(grams/minute). Both meshes were placed under a compression of 1 MPa. The electrical resistivity of the thin mesh was 2,500 mOhm·cm$^2$ while the electrical resistivity of the thick mesh was 150 mOhm·cm$^2$. The porous flow fields disclosed herein can provide sufficient functionality to their electrolyzer cells with resistivity values as high as 5,000 mOhm·cm$^2$. At this scale, the fluid resistances are generally very low and operating pressure is not an issue. The porous flow fields disclosed herein can provide sufficient functionality to their electrolyzer cells with a resistivity value as lower or lower than 10 mOhm·cm$^2$. However, at values this low, operating pressure for assuring efficient distribution of the reactants or electrolytes through the flow fields becomes difficult.

In common usage, patterned flow fields in the polar plate restrict overall gas flow, but in particular provide sufficient backpressure on product gases to maintain a high pressure differential between the cathode and the anode. Because open porous meshes as described in this disclosure allow greater flow of gas away from the membrane nearer the polar plate, it has been more difficult to control the cathode-side pressure. These meshes act as an additional gas diffusion layer to the electrode, and configurations with smaller pores near the electrode encourage mixing to bring more reactants into contact with the catalyst; it has been thought that they also had the potential to allow too much gas to escape, therefore lowering the overall reaction efficiency as well as increasing undesirable by-products.

However, surprisingly the opposite has proven to be true. It was thought that some main advantages of conductive meshes as compared to standard flow fields used for gas-phase electrodes would be reduced cost and easier manufacturability. With careful selection of the mesh pore sizes, sufficient fluid flow of reactant gases is allowed to achieve high efficiency of conversion. Backpressure on the cathode side can be maintained to result in a positive pressure differential by controlling the reactant flows on both anode and cathode sides, as well as externally restricting the flow of gaseous products on the output side of the cathode polar plate interfaces by, for example, a backpressure regulating valve. In addition, monitoring the pressure at the cathode and anode outputs can be used to actively control the pressure differential between the cathode and anode side to minimize the effect of input flow fluctuations on electrolyzer performance. Contrary to expectations, conductive mesh flow fields exhibit improved properties compared to standard flow fields as evidenced in the next figures.

Figure 8:
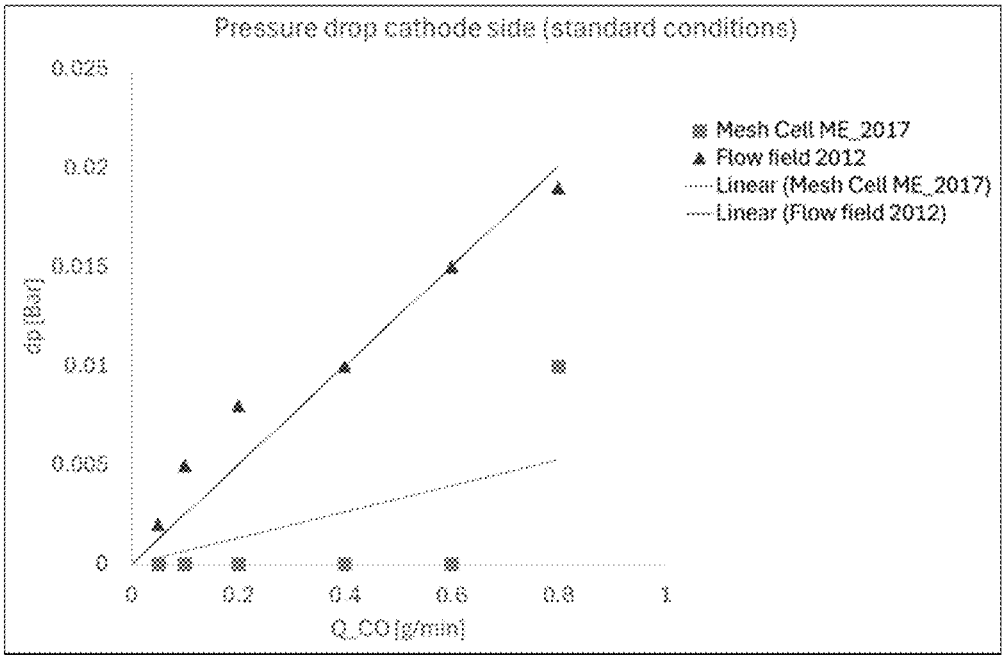
FIG. 8 includes two plots that give a comparison of a configuration of conductive mesh with a cell containing only a standard patterned flow field.
Figure 8:
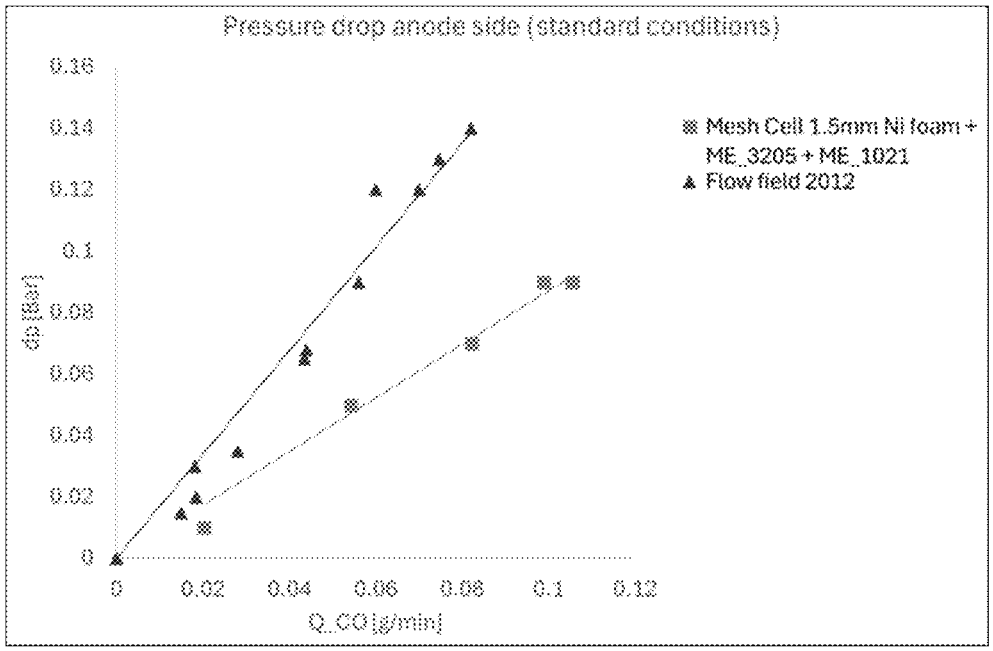

FIG. 8 shows two plots that give a comparison of a configuration of conductive mesh with a cell containing only a standard patterned flow field. The top figure shows pressure drop vs. mass flow of the reactants at the cathode, and the bottom figure shows pressure drop vs. mass flow of the reactants at the anode. Both cells use a similar membrane and cell area. Though these are affected by mesh height, pore size, and other parameters, in this configuration reactant flow at a given input pressure is higher for the conductive mesh cell as shown by the lower slope of the pressure drop. Lower necessary pressure to achieve the same reactant flow is advantageous, as greater variability in pressure could lead to changes in the electrical and mechanical contact of the catalyst with the membrane.

Figure 9:
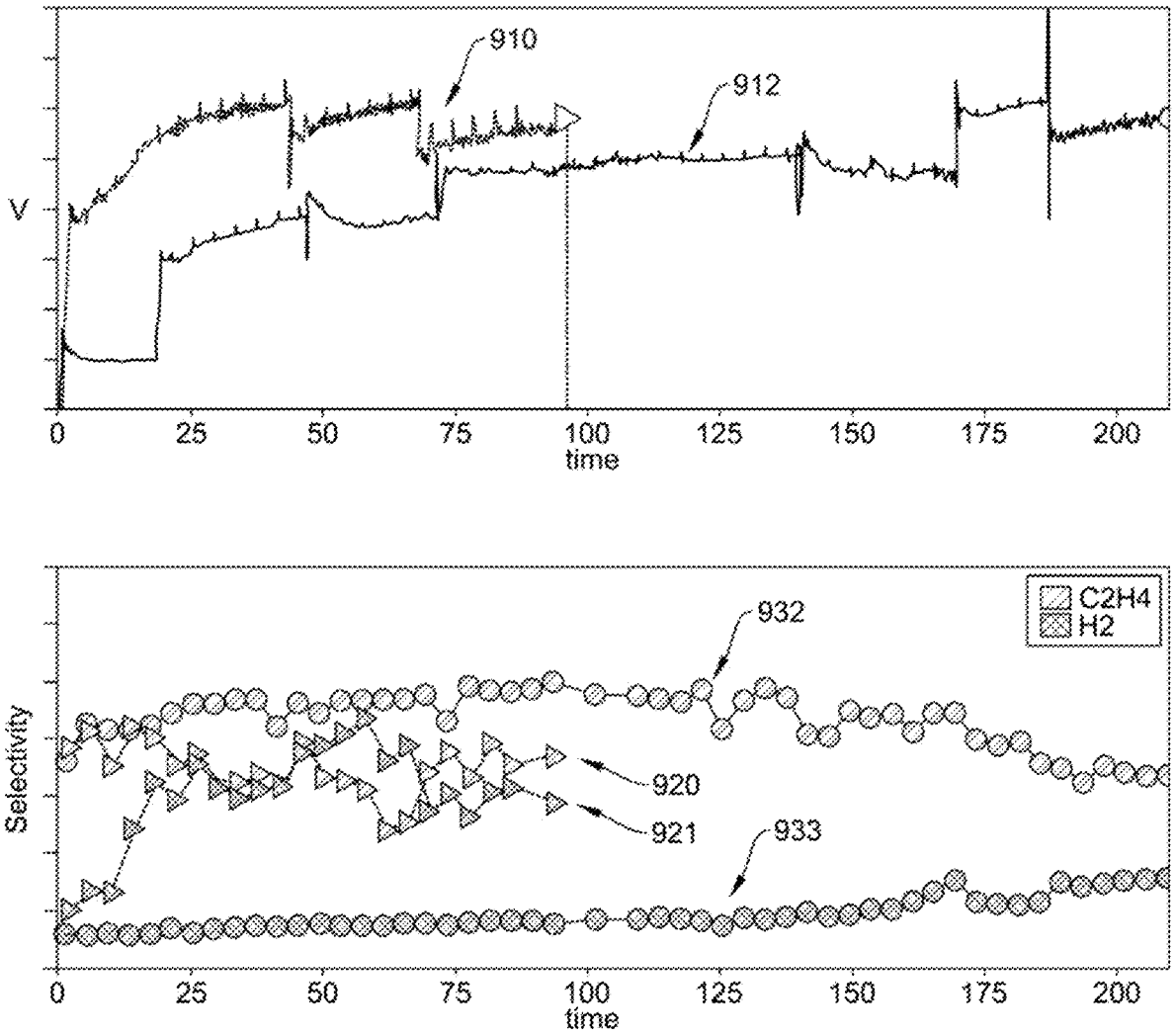
FIG. 9 includes two plots showing the voltages and output selectivity of two electrolyzer configurations in accordance with specific embodiments of the inventions disclosed herein.

FIG. 9 shows two plots again comparing the same two cells of FIG. 8. In the upper plot, the plot shows voltage (V) vs. time in minutes. Trace 910 shows the electrochemical voltage driving the cell with the standard flow field, and trace 912 shows the same voltage over time for the cell with a conductive mesh. Voltage is lower at all times for the conductive mesh cell up to the point where the first cell failed. Lower voltage implies higher Faradaic efficiency (FE) of a cell and is considered an improvement. In the lower plot, production of ethylene ($C_2H_4$) and hydrogen gas ($H_2$) are shown for both cells. The standard flow field cell displays the level of ethylene and hydrogen gas production in traces 920 and 921 respectively. Though there is initial separation in this configuration, over time the selectivity between ethylene and hydrogen degrades until they are at similar levels. In contrast, for the conductive mesh cell, ethylene and hydrogen gas production are shown as traces 932 and 933 respectively. Here, selectivity is much better over the entire run, and furthermore, the desired product, ethylene is produced at a higher rate than in the other cell.

One possibility for these improved results may be even pressure of the conductive mesh on the electrode catalyst of the gas-phase side, in our example, the cathode. A polar plate with patterned channels etched or otherwise formed on the surface has many open spaces where gaseous reactants and products must enter and leave. In these open spaces, the plate can offer little or no pressure on the GDL electrode. In contrast, in a cell with a conductive mesh, the flat polar plate can exert even pressure across the entire surface of the conductive mesh, and then the mesh itself can further distribute that force evenly across the catalyst to ensure consistent contact of the catalyst with the membrane. This is the most likely cause of the lower voltage needed for the reaction in the conductive mesh cell.

Figure 10:
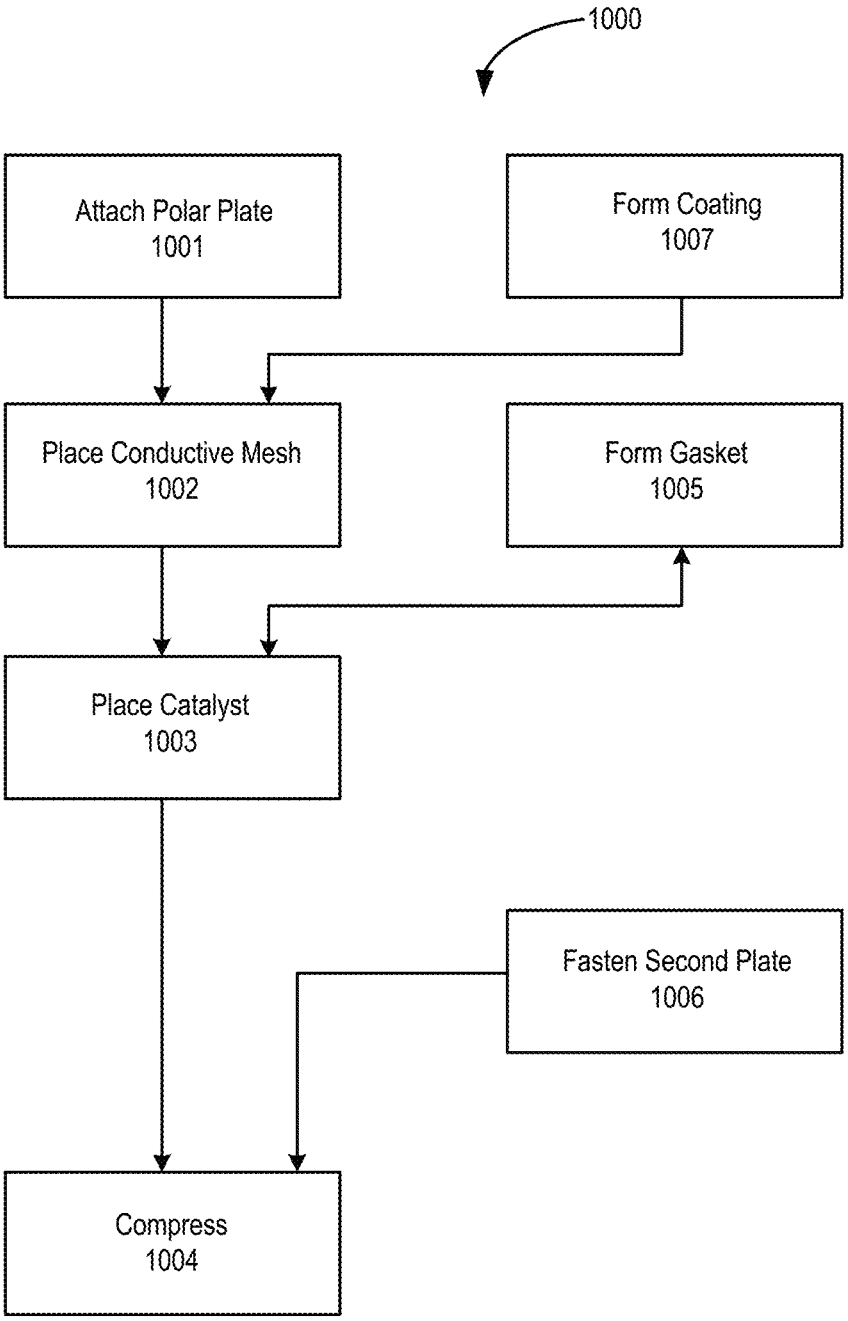
FIG. 10 is a flow chart of a method of forming an electrolyzer cell with a fluid distribution system in accordance with specific embodiments of the inventions disclosed herein.

FIG. 10 shows flow chart 1000 of a method of forming an electrolyzer cell with a fluid distribution system in accordance with specific embodiments of the inventions disclosed herein. Flow chart 1000 includes step 1001 of attaching a polar plate to a first cell compression plate. Through the execution of this step, the polar plate and the cell compression plate form an electrode fluid inlet and an electrode fluid outlet. The fluid inlet may be formed partially by the polar plate and partially by the compression plate. Flow chart 1000 continues with step 1002 of placing an electrically conductive mesh on the polar plate. The electrically conductive mesh can be a compressible electrically conductive mesh that first goes over the active area of the polar plate. Flow chart 1000 continues with step 1003 of placing an electrode catalyst on the electrically conductive mesh. The electrode catalyst can be part of an MEA that is placed over the electrically conductive mesh. The electrode catalyst can be located on an electrode. The electrode catalyst can be in contact with the electrically conductive mesh. The electrically conductive mesh can have any of the characteristics described above with reference to the compressible electrically conductive materials described herein.

Flow chart 1000 continues with step 1004 of compressing, in a compression using the first cell compression plate, the electrically conductive mesh such that it is a compressed electrically conductive mesh. Through the execution of this step the compressed electrically conductive mesh can be positioned to allow a fluid flow from the electrode fluid inlet to the electrode fluid outlet through the electrically conductive compressed mesh. Through the execution of this step the compressed electrically conductive mesh can be compressed to between 20% to 40% of a volume of the electrically conductive mesh.

In specific embodiments, the electrode catalyst can be a cathodic catalyst. In specific embodiments, the electrode catalyst can be an anodic catalyst. In specific embodiments, the fluid flow can be a gaseous cathodic feedstock flow. In specific embodiments, the fluid flow can be an aqueous anodic feedstock flow.

Flow chart 1000 includes step 1005 of forming a gasket having a cutout shaped to the compressed electrically conductive mesh, the electrode fluid inlet, and the electrode fluid outlet. The gasket can be a loose gasket and is compressed in step 1004 with the compressed electrically conductive mesh to form a seal for the electrolyzer cell. The cutout shape can allow for reactants or electrolyte to flow from the inlet of the cell into contact with the electrode of the cell without leaking out from the active area of the cell to the periphery of the cell.

Flow chart 1000 includes step 1006 of fastening a second compression plate to the first compression plate. The compression plate and second compression plate can be used in step 1004 in that the compression uses the compression plate and the second compression plate. As the two plates are pressed towards each other the cell can be compressed. The second compression plate can be unique to the cell such that the cell has its own independent compression plates. Alternatively, the second compression plate can be shared by other cells or an entire stack in which the cell is a part. The compression plates can be compressed together using fastening means such as screws or rivets. The compression plates can be compressed together using a molding process or adhesive that is formed or applied while the plates are under compression from an external force.

Flow chart 1000 includes step 1007 of forming a coating on the electrically conductive mesh. This step can be conducted before the electrically conductive mesh is placed in the electrolyzer cell and can be conducted to decrease the electrical resistance of the mesh. The coating can be any material with a lower electrical resistance than the main portion of the mesh including gold or platinum.

Figure 11:
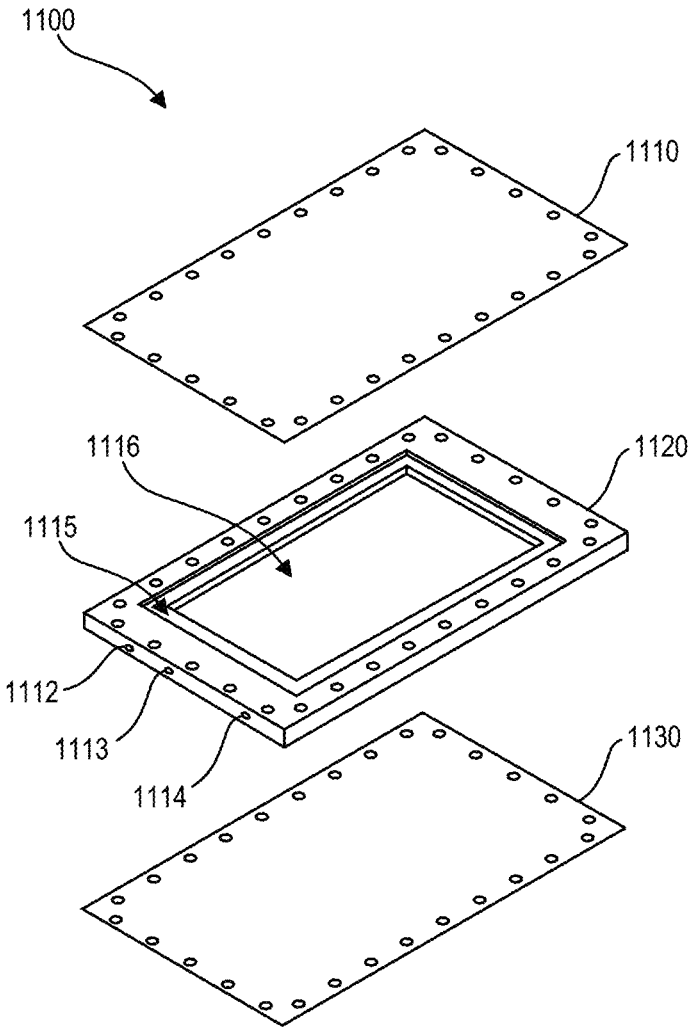
FIG. 11 illustrates a modular electrolyzer cell in accordance with specific embodiments of the inventions disclosed herein.

FIG. 11 shows portions of electrolyzer cell 1100 in accordance with specific embodiments of the inventions disclosed herein. In this example, cell 1100 is similar in nature to the embodiment shown in FIG. 4, however cell 1100 can be implemented in a modular fashion where the cell is not connected fluidly in a stack. Rather than bipolar plates, monopolar plates are used on the top and bottom. FIG. 11 is shown in an exploded view, where the various components can be assembled together. In specific embodiments, a flat metal plate 1110, comprising, for example, stainless steel, can be used to cover the cathode side on top. In specific embodiments, flat metal plate 1130, comprising, for example, nickel, can be used to cover the anode side on the bottom. In between, a cell frame 1120 can be placed that holds the MEA including two compressible meshes on either side. The cell frame can have open hole 1116 which holds a membrane. Compressible meshes can be placed in depression 1115 above and below the membrane. A similar depression not shown can be found on the underside of cell frame 1120 for the anode side compressible mesh. Cell frame 1120 can consist of plastic, metal, or another material. Fluid inputs can be configured to connect to various holes (not shown) internal to cell frame 1120, for example within depression 1115 on the cathode side or the similar depression on the anode side. Fluid inputs 1112 and 1113 can connect to the cathode side, and inputs 1114 could connect to the anode side. Fluid outputs cannot be seen on the back side of cell frame 1120 but are similar to the fluid inputs. Gaskets can also be provided on the flat surfaces or in grooves between plate 1110 and cell frame 1120, and similarly between plate 1130 and cell frame 1120. The entire assembly can be fastened together with screws or other fasteners to provide pressure on the internal components and prevent leakage.

Figure 12:
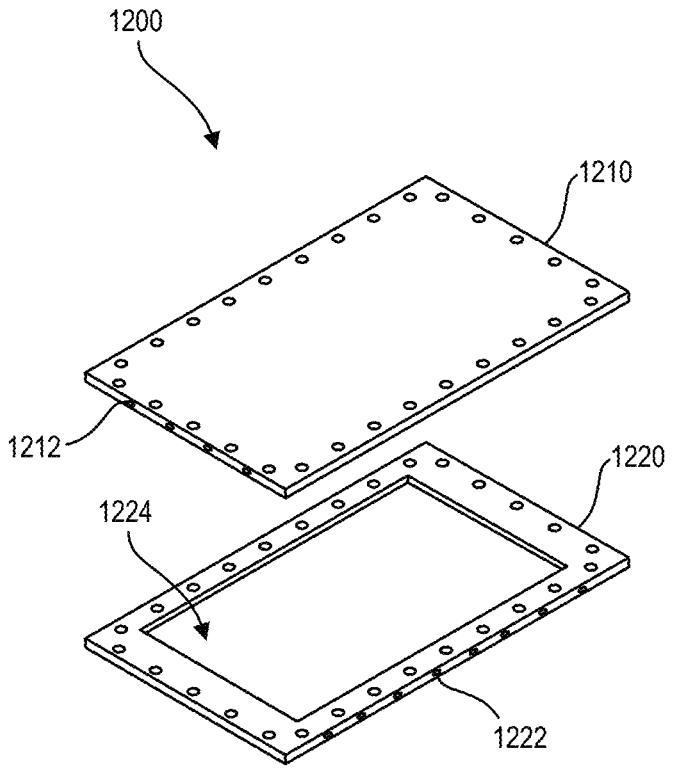
FIG. 12 illustrates a modular electrolyzer cell in accordance with specific embodiments of the inventions disclosed herein.

FIG. 12 shows portions of electrolyzer cell 1200 in accordance with specific embodiments of the inventions disclosed herein. In this example, cell 1200 is similar in nature to cell 1100 shown in FIG. 11, where cell 1200 can be implemented in a modular fashion where the cell is not connected fluidly in a stack. Again, rather than bipolar plates, monopolar plates are used on the top and bottom. FIG. 12 is shown in an exploded view, where the various components can be assembled together. Cell 1200 does not include a cell frame, but instead comprises two metal plates 1210 and 1220. Cathode plate 1210 includes fluid inputs 1212 on one side edge and corresponding outputs on another edge. Similarly, anode plate 1220 can include fluid inputs 1222 with corresponding outputs on another edge. In this example, the cathode and anode inputs are configured to be on different sides for ease of connecting external fluid tubes or other connections, but they may be configured to be on the same sides. Each plate can have a depression 1224 (which is not a through hole), so that when assembled, a cavity is created to hold a cathode compressible mesh, a membrane, and an anode compressible mesh. Gaskets can also be provided between the two plates. In one example, the cathode plate comprises stainless steel, and the anode plate comprises nickel.

While the specification has been described in detail with respect to specific embodiments of the invention, it will be appreciated that those skilled in the art, upon attaining an understanding of the foregoing, may readily conceive of alterations to, variations of, and equivalents to these embodiments. For example, while the example of an electrolyzer with an MEA was used throughout this disclosure the approaches disclosed herein are applicable to other electrolyzer cell compositions including those that use separators generally between the two halves of the cell. As another example, while the example of a CO electrolyzer was used throughout this disclosure, the approaches disclosed herein are applicable to other electrolyzers including $CO_2$ electrolyzers and electrolyzers and fuel cells more generally. These and other modifications and variations to the present invention may be practiced by those skilled in the art, without departing from the scope of the present invention, which is more particularly set forth in the appended claims.

What is claimed is:

1. A carbon oxide electrolyzer cell comprising:
a polar plate;
a cathode area;
a carbon oxide reactant gas serving as a reduction substrate in the cathode area;
a cathode fluid inlet;
a cathode fluid outlet;
an anode area;
a liquid oxidation substrate in the anode area; and
a compressed electrically conductive mesh: (i) in electrical contact with the polar plate; and (ii) that provides a fluid path from the cathode fluid inlet to the cathode fluid outlet for the carbon oxide reactant gas through the compressed electrically conductive mesh;
wherein a pore size throughout the compressed electrically conductive mesh changes with distance away from the polar plate.

2. The carbon oxide electrolyzer cell of claim 1, further comprising:
a second polar plate;
an aqueous anolyte in the anode area;
an anode fluid inlet;
an anode fluid outlet; and
a second compressed electrically conductive mesh: (i) in contact with the second polar plate; and (ii) that provides a second fluid path from the anode fluid inlet to the anode fluid outlet for the aqueous anolyte through the second compressed electrically conductive mesh.

3. The electrolyzer cell of claim 2, wherein:
the second compressed electrically conductive mesh is formed of nickel.

4. The electrolyzer cell of claim 2, wherein:
the second compressed electrically conductive mesh is a foam or a structured mesh.

5. The electrolyzer cell of claim 1, wherein a pressure in the cathode area is greater than a pressure in the anode area.

6. The electrolyzer cell of claim 1, wherein the electrolyzer cell is part of an electrolyzer stack and the electrolyzer stack further comprises:
a first compression plate; and
a second compression plate fastened to the first compression plate so as to compress the electrolyzer cell;
wherein the compressed electrically conductive mesh is compressed by the first compression plate and the second compression plate; and
the compressed electrically conductive mesh is compressed evenly across its surface.

7. The electrolyzer cell of claim 1, wherein:
the compressed electrically conductive mesh is a metal foam.

8. The electrolyzer cell of claim 1, wherein:
the compressed electrically conductive mesh is structured metal.

9. The electrolyzer cell of claim 8, wherein:
layers of the compressed electrically conductive mesh are welded together.

10. The electrolyzer cell of claim 8, wherein:
layers of the compressed electrically conductive mesh are sintered together.

11. The electrolyzer cell of claim 1, wherein:
layers of the compressed electrically conductive mesh form an electrical connection by mechanical pressure on the layers.

12. The electrolyzer cell of claim 1, wherein:
the compressed electrically conductive mesh is a polymer with carbon added;
wherein the carbon is in the form of an expanded graphite foam or carbon powder.

13. The electrolyzer cell of claim 1, wherein:
the compressed electrically conductive mesh includes carbon in the form of a carbon fiber cloth or carbon powder.

14. The electrolyzer cell of claim 1, wherein:
an average pore size in the compressed electrically conductive mesh becomes smaller with greater distance from the polar plate.

15. A carbon oxide electrolyzer cell comprising:
a polar plate;
a cathode area;
a carbon oxide reactant gas serving as a reduction substrate in the cathode area;
a cathode fluid inlet;
a cathode fluid outlet;
a membrane;
a compressed electrically conductive mesh: (i) comprising steel; (ii) in electrical contact with the polar plate; and (iii) that provides a fluid path from the cathode fluid inlet to the cathode fluid outlet for the carbon oxide reactant gas through the compressed electrically conductive mesh; and
a separate carbon-based gas diffusion layer having a catalyst thereon between the compressed electrically conductive mesh and the membrane;
wherein a pore size throughout the compressed electrically conductive mesh changes with distance away from the polar plate.

16. The carbon oxide electrolyzer cell of claim 15, further comprising:
a second polar plate;
an anode area;
an aqueous anolyte in the anode area;
an anode fluid inlet;
an anode fluid outlet; and
a second compressed electrically conductive mesh: (i) in contact with the second polar plate; and (ii) that provides a second fluid path from the anode fluid inlet to the anode fluid outlet for the aqueous anolyte through the second compressed electrically conductive mesh.

17. The electrolyzer cell of claim 16, wherein:
the second compressed electrically conductive mesh is formed of nickel.

18. The electrolyzer cell of claim 16, wherein:

the second compressed electrically conductive mesh is a foam or a structured metal mesh.

19. The electrolyzer cell of claim 15, further comprising:

an anode area, wherein a pressure in the cathode area is greater than a pressure in the anode area.

20. The electrolyzer cell of claim 15, wherein the electrolyzer cell is part of an electrolyzer stack and the electrolyzer stack further comprises:

a first compression plate; and a second compression plate fastened to the first compression plate so as to compress the electrolyzer cell;

wherein the compressed electrically conductive mesh is compressed by the first compression plate and the second compression plate; and the compressed electrically conductive mesh is compressed evenly across its surface.

21. The electrolyzer cell of claim 15, wherein:

the compressed electrically conductive mesh is a metal foam.

22. The electrolyzer cell of claim 15, wherein:

the compressed electrically conductive mesh is structured metal.

23. The electrolyzer cell of claim 15, wherein:

layers of the compressed electrically conductive mesh are welded together.

24. The electrolyzer cell of claim 15, wherein:

layers of the compressed electrically conductive mesh are sintered together.

25. The electrolyzer cell of claim 15, wherein:

layers of the compressed electrically conductive mesh form an electrical connection by mechanical pressure on the layers.

26. A method of forming an electrolyzer cell, comprising:

attaching a polar plate to a first compression plate, whereby the polar plate and the first compression plate form an electrode fluid inlet and an electrode fluid outlet;

placing an electrically conductive mesh on the polar plate;

placing an electrode catalyst on the electrically conductive mesh; and compressing, in a compression using the first compression plate, the electrically conductive mesh such that it is a compressed electrically conductive mesh, whereby a pore size throughout the compressed electrically conductive mesh changes with distance away from the polar plate and the compressed electrically conductive mesh is positioned to allow a fluid flow from the electrode fluid inlet to the electrode fluid outlet through the compressed electrically conductive mesh.

* * * * *